US012351353B2

(12) United States Patent
Evans

(10) Patent No.: US 12,351,353 B2
(45) Date of Patent: Jul. 8, 2025

(54) STRAW FILLER SYSTEMS AND METHODS

(71) Applicant: SJS Machine, LLC, Fayetteville, TN (US)

(72) Inventor: Stanley Evans, Fayetteville, TN (US)

( * ) Notice: Subject to any disclaimer, the term of this patent is extended or adjusted under 35 U.S.C. 154(b) by 0 days.

(21) Appl. No.: 18/201,603

(22) Filed: May 24, 2023

(65) Prior Publication Data

US 2024/0391625 A1 Nov. 28, 2024

(51) Int. Cl.
*B65B 43/50* (2006.01)
*B65B 37/12* (2006.01)

(52) U.S. Cl.
CPC ..... *B65B 43/50* (2013.01); *B65B 37/12* (2013.01)

(58) Field of Classification Search
CPC ..... B65B 43/50
See application file for complete search history.

(56) References Cited

U.S. PATENT DOCUMENTS 4,939,884 A * 7/1990 Peters ..... B65B 7/14 141/144
11,021,286 B1 * 6/2021 Roberts ..... B65B 35/08

* cited by examiner

*Primary Examiner* — Jason K Niesz

(57) ABSTRACT

The present disclosure is a straw filler system that has a first motor and a straw filler device. The straw filler device has a fill cap fixedly coupled to a base forming an internal cavity. The base has a plurality of external openings on its periphery for receiving a plurality of straws and holding the plurality of straws in place while being filled with a viscous material, and the plurality of external openings are in fluid communication with a plurality of internal openings within the internal cavity via a plurality of respective channels. The straw filler system further has a motor hub fixedly coupled to the first motor and rotatably coupled to the base, the motor hub configured for axially rotating the straw filler device so that centrifugal force forces the viscous material to travel from the cavity to the plurality of straws.

14 Claims, 5 Drawing Sheets

STRAW FILLER SYSTEMS AND METHODS

BACKGROUND

Honey straws, also known as honey sticks, are convenient straw-like containers filled with honey. Typically, the honey straws are made with all-natural honey. They are known to be a tasty treat, but they also provide a great source of energy.

Some honey straws contain home mixtures also made with natural fruit, flavors, and spices. They naturally contain antioxidants and are exposed to pollen, which aids users to minimize allergy systems.

There are many ways to enjoy honey straws. One can use the honey straws in tea. In this regard, a honey straw may contain a teaspoon of honey, which is the perfect amount for sweetening one's tea. Also, users may enjoy the honey straws as a snack.

DETAILED DESCRIPTION OF THE DRAWINGS

The present disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

Figure 1:
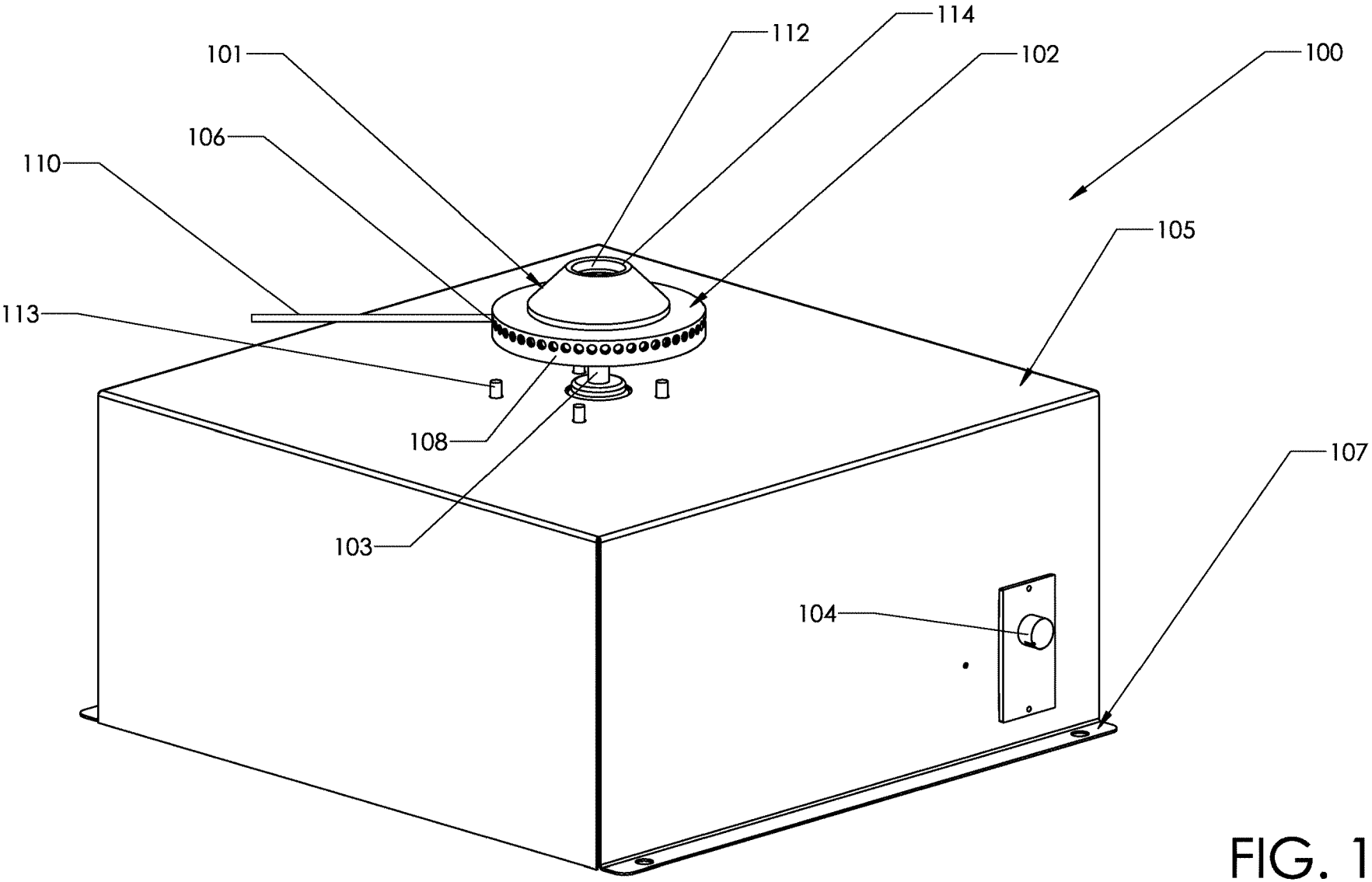
FIG. 1 is a perspective view of a straw filler system in accordance with an embodiment of the present disclosure.

FIG. 1 is an exemplary straw filler system 100 in accordance with an embodiment of the present disclosure. In this regard, the straw filler system 100 is configured for filling a plurality of straws 110 with a viscous material, e.g., honey, using centrifugal force.

The exemplary straw filler system 100 comprises a straw filler device 102 and a metal box 105. Operating components (not shown) of the straw filler system 100 are contained in the metal box 105. The components are described herein. The straw filler device 102 is coupled to the metal box 105 via one or more bolts 113.

The metal box 105 may be cubical or rectangular cuboid. However, other shapes of boxes may be used in other embodiments.

In one embodiment, coupled to the outside of the metal box 105 is a button 104. The button 104, when actuated, initiates operation of the straw filler system 100. While a button is shown in FIG. 1, other types of actuating devices may be used in other systems, e.g., a switch.

The straw filler device 102 comprises a fill cap 101 that is sealed atop a circular, cylindrical base 107. The cap 101 may be shaped like a conical frustrum as shown. While the fill cap 101 is shown as a conical frustrum, the fill cap 101 may be other shapes in other embodiments.

At the circular top of the fill cap 101 is an opening 114. The opening 114 is configured for receiving a viscous material (not shown), e.g., honey. In this regard, an operator (not shown) pours the viscous material into a cavity (not shown) defined by the fill cap 101 and the base 107.

The base 107 is substantially cylindrical and has a curved surface 108 extending around the periphery of the base 107. The curved surface 108 comprises a plurality of openings 106. The openings 106 receive straws 110 inserted therein, thereby providing access to channels (not shown). The channels direct the viscous material from the cavity defined by the fill cap 101 and the base 107 through the straws 110 using centrifugal force. In this regard, the straw filler device 102 is axially rotated, and viscous material within the cavity defined by the fill cap 101 and the base 107 travels from the cavity into the straws 110 through the channels.

The straws 110 remain in the openings 106 during operation when viscous material is being provided to the straws 110. Thus, the straws 110 are protected during operation. Protection of the straws 110 mitigates the risk that straws 110 damage or brake lose during operation.

The straw filler device 102 is rotatably coupled to the to the top of the metal box 105 via a motor driven hub 103. In this regard, within the metal box 105 is a motor (not shown) that is coupled to the motor driven hub 103. When the motor driven hub 103 is rotated axially by the motor, the straw filler device 102 rotates accordingly.

In operation, a plurality of empty straws 110 is inserted in the openings 106 peripherally along the curved surface 108. The viscous material (e.g., honey) is poured into the opening 114 at the top of the fill cap 101 into an internal cavity (not shown).

An operator (not shown) actuates the button 104, which activates the motor within the metal box. The motor quickly turns the straw filler device 102, and through centrifugal force, the straws 110 are quickly filled with viscous material (e.g., hone) from the internal cavity.

Figure 2:
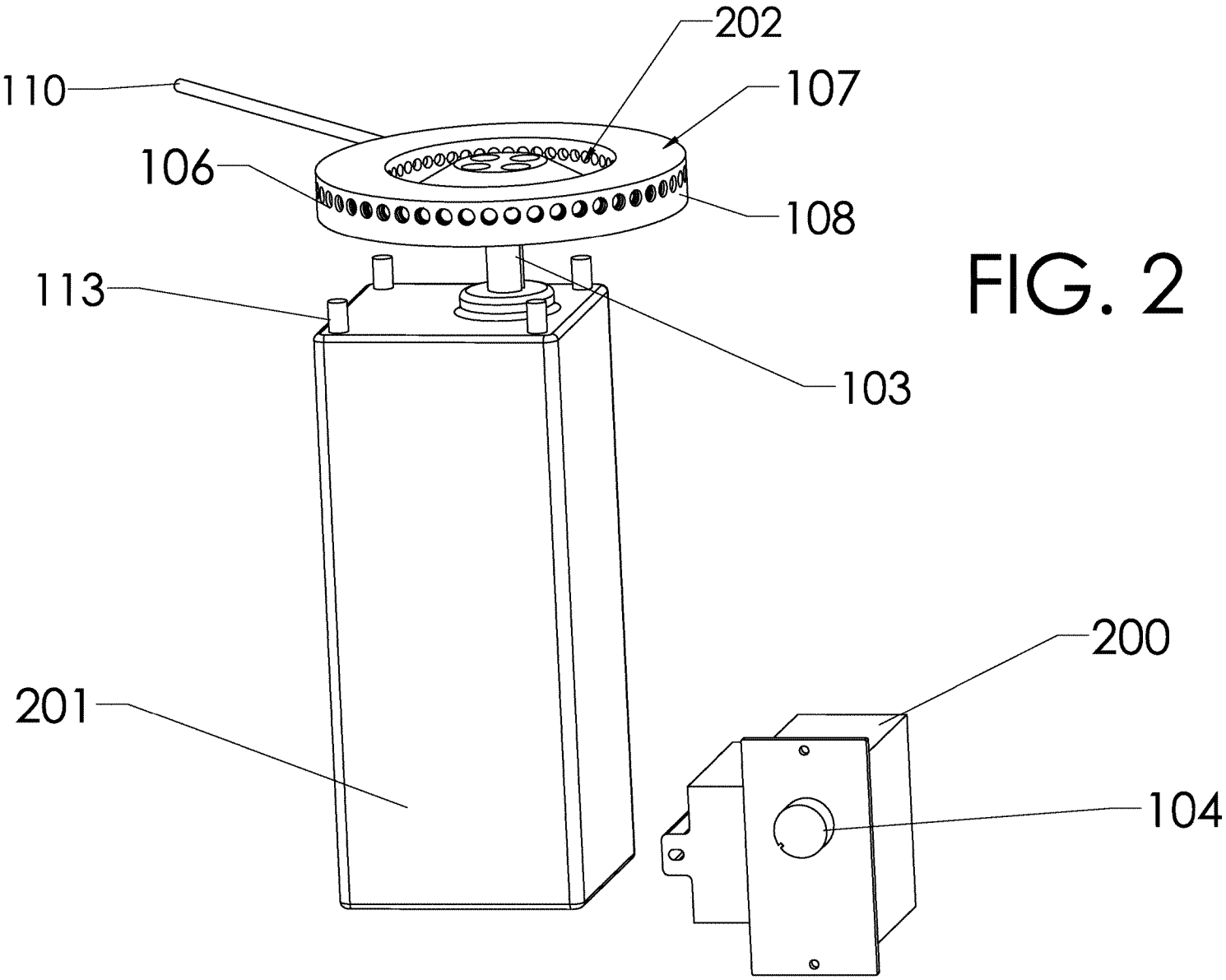
FIG. 2 is a perspective view of a motor for driving a base of a straw filler device as shown in FIG. 1.

FIG. 2 is an exploded view of the straw filler system 100. In this regard, the straw filler system 100 further comprises a motor 200. In one embodiment, the motor 200 is a variable speed motor. However, other types of motors may be used in other embodiments. The variable speed motor 200 is turned on using the button 104 actuated by the operator.

When turned on, the motor 200 activates a motor 201. In one embodiment, the motor 201 is a gear-driven motor. However, other types of motors may be used in other embodiments.

When activated, the motor 201 rotates the motor hub 103, which is fixedly coupled to the straw filler device 102. As the axle motor hub 103 rotates, the straw filler device 102 rotates therewith.

Through centrifugal force, viscous material (e.g., honey) contained in a cavity 202 formed by the conical fill cap 101 (FIG. 1) and the base 107 is forced through the straws 110 (FIG. 1) coupled to the openings 106 inserted through the channels (not shown) base 107. Thus, the straws 110 are filled with the viscous material (e.g., honey).

Figure 3:
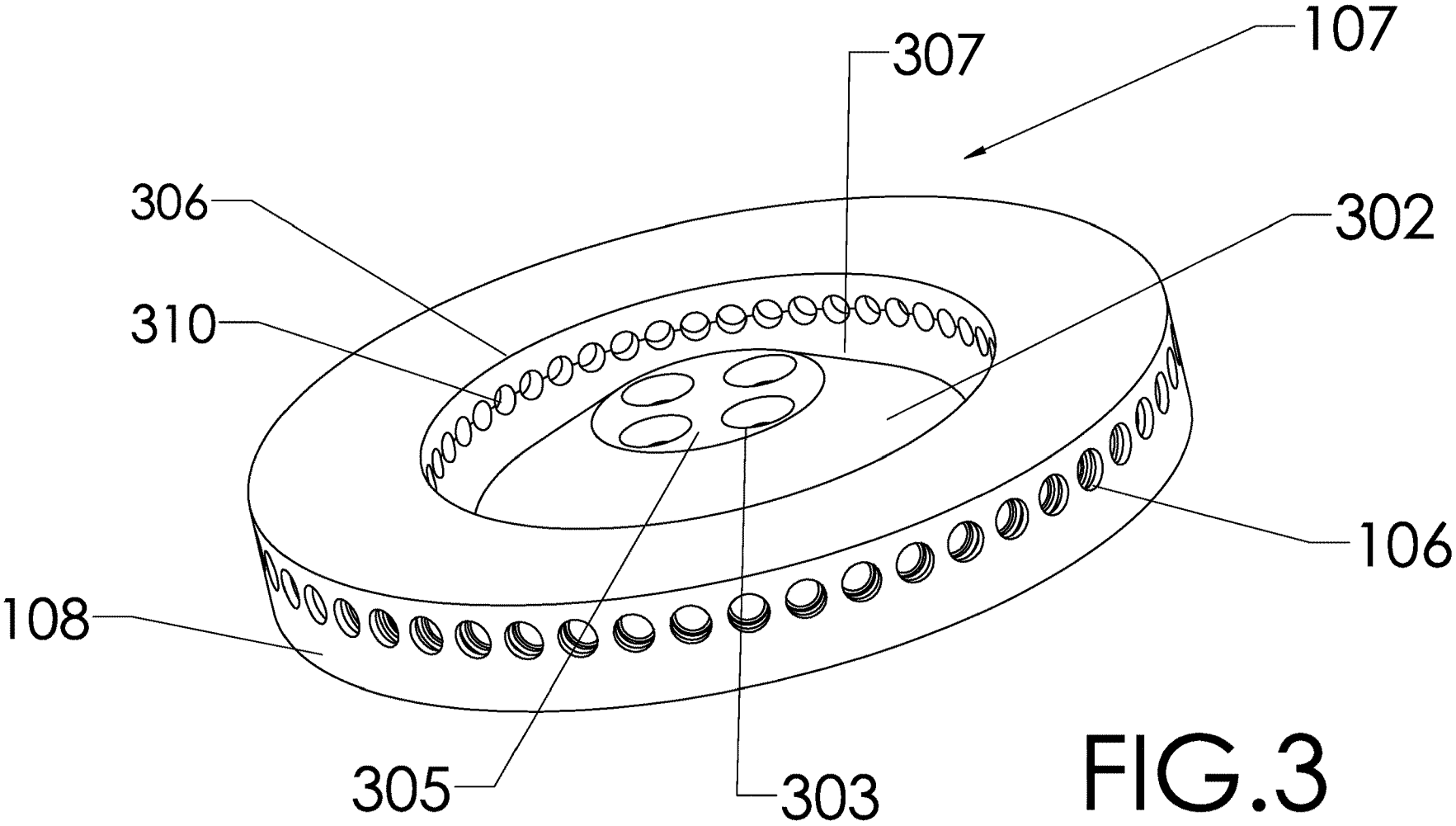
FIG. 3 is a perspective view of the base of the straw filler device as shown in FIG. 1.

FIG. 3 is a perspective view of an exemplary embodiment of the base 107. In such an embodiment, the base 107 is circular. There is an annular aperture 306 in the center of base 107 that descends into the base 107 forming an internal cavity 307.

Openings 106 on the periphery curved surface 108 receive straws 110 (FIG. 1). The openings 106 are in fluid communication with respective openings 310 via channels (not shown).

Cavity 307 comprises a convex floor 302. In the center of the convex floor 302 is a circular top base 305 having circular openings 303 therein. Four openings are shown; however, there may be fewer or more openings in other embodiments.

In operation, the viscous material (e.g., honey) is poured through the conical opening 114 (FIG. 1) at the top of the conical fill cap 101 into the internal cavity 307. As the straw filler device 102 spins, viscous material (not shown) is forced into straws 110 (FIG. 1) coupled to the openings 106 through channels 306. In operation, the openings 303 in the top base 305 catch superfluous viscous material and recirculate the viscous material, thereby not wasting excess viscous material.

Figure 4:
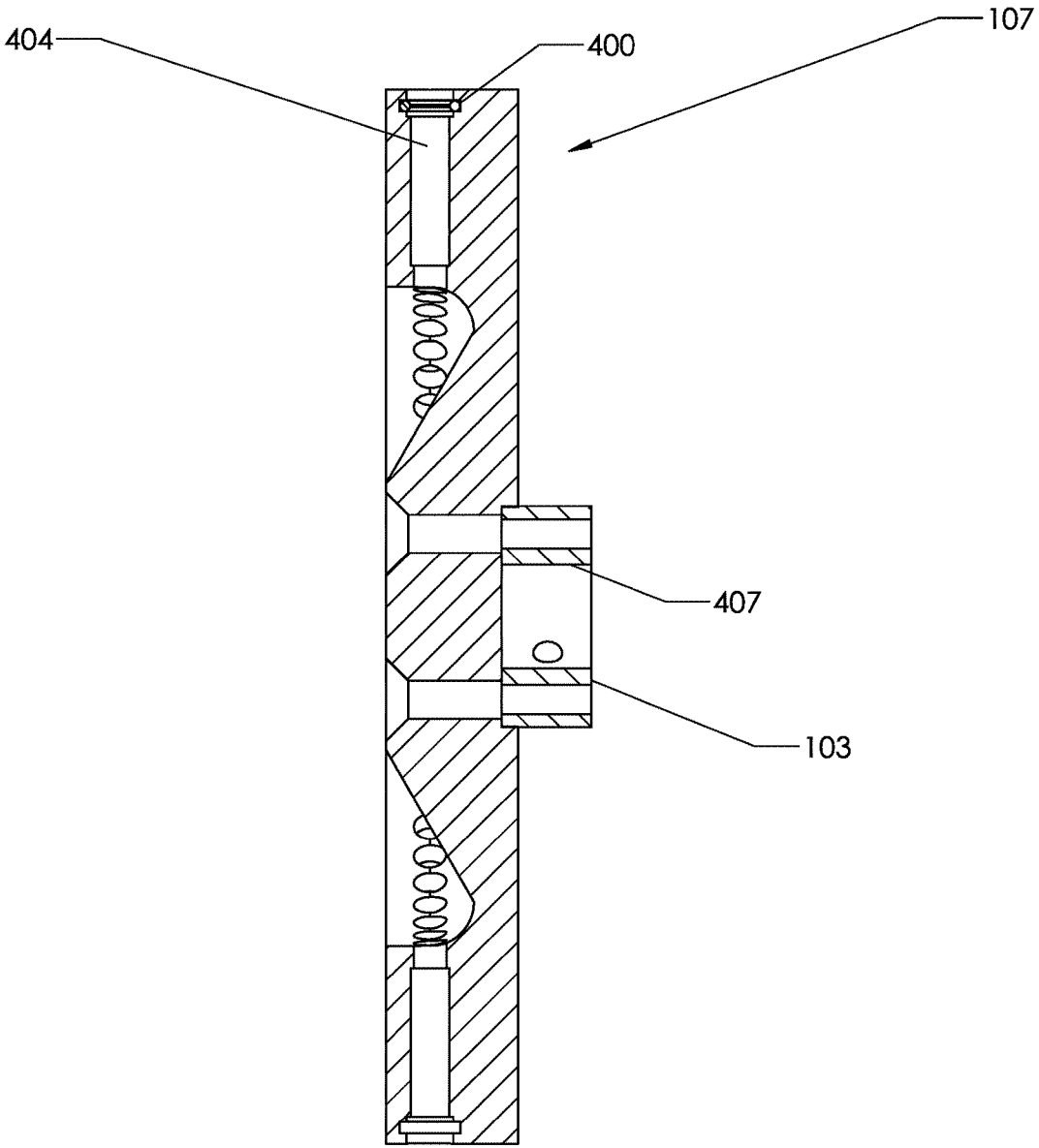
FIG. 4 is a cross sectional view of the base of the straw filler device as shown in FIG. 1.

FIG. 4 is a cross-sectional view taken of the base 107 showing the motor-driven hub 103 and the base 107. Motor-driven hub 103 receives a shaft (not shown) in an opening 407. When the shaft rotates via motor 201 (FIG. 2), the straw filler device 102 rotates. As straw filler device 102 rotates, viscous material (not shown) contained in the internal cavity 307 is forced by the centrifugal force into straws 110 (FIG. 1) coupled to the openings 106 (FIG. 1) on the periphery of the base 107.

The base 107 comprises a plurality of precision-machined channels 404. Only two precision-machined channels are shown in FIG. 4; however, there are a plurality of channels for each opening 106 for receiving straws 110 (FIG. 1). In this regard, the channels 404 provide fluid communication from internal openings 310 (FIG. 3) to the external openings 106 (FIG. 1).

On an outside end of the precision-machined channel is an O-ring 400 that prevents viscous material from leaking when the straws 110 are being filled. Note that an O-ring is a mechanical gasket in the shape of a torus, and it is a loop of elastomer with a round cross-section. Used here, the O-ring 400 prevents viscous material from escaping as it acts as a sealing device. Because it is squeezed between two surfaces, it takes up the clearance and prevents any viscous material from being released.

Figure 5:
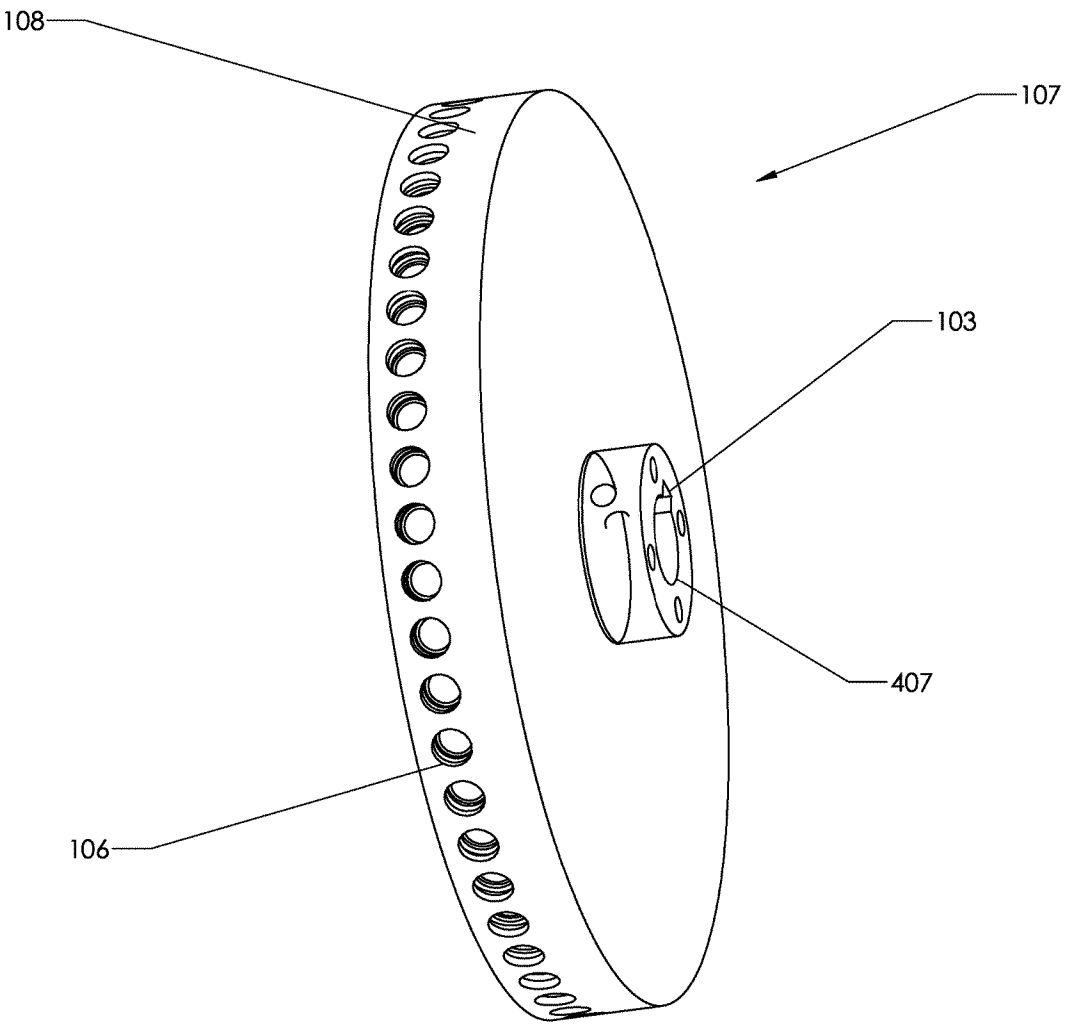
FIG. 5 is a side perspective view of a base of the straw filler device.

FIG. 5 is a side perspective view of the base 107. In this regard, the base 107 is fixedly coupled to the motor-driven hub 103. The motor-driven hub 103 comprises an aperture 407 for receiving a shaft (not shown) that is rotatably coupled to the motor 201 (FIG. 2).

In one embodiment, the base 107 is cylindrical having an external curved surface 108. Openings 106 are machined into the external curved surface 108. The openings 106 allow access to the channels 404 (FIG. 4). In this regard, straws 110 are inserted into the openings 106 and through the channels 404.

The invention claimed is:

1. A straw filler system, comprising: a motor;

a straw filler device comprising a fill cap fixedly coupled to a base forming an internal cavity, the base comprising a plurality of external openings on its periphery for receiving a plurality of straws and holding the plurality of straws in place while being filled with a viscous material, the plurality of external openings in fluid communication with a plurality of internal openings within the internal cavity via a plurality of respective channels a motor hub fixedly coupled to the first motor and rotatably coupled to the base, the motor hub configured for axially rotating the straw filler device so that centrifugal force forces the viscous material to travel from the cavity to the plurality of straws.

2. The straw filler system of claim 1, wherein the motor that is initiated by an actuator.

3. The straw filler system of claim 1, wherein the openings comprise O-rings to prevent honey from escaping, the O-rings coupled in proximity to the external openings.

4. The straw filler system of claim 1, wherein the base is circular.

5. The straw filler system of claim 1, wherein the channels are enclosed in the base.

6. The straw filler system of claim 1, wherein the motor is a gear-driven motor.

7. The straw filler system of claim 1, wherein the fill cap is a conical frustrum.

8. The straw filler system of claim 7, wherein the conical frustrum comprises an aperture on a top base.

9. The straw filler system of claim 1, further comprising a box, the box housing the first motor.

10. The straw filler system of claim 9, wherein the first motor is coupled to the box via one or more bolts.

11. The straw filler system of claim 1, wherein the base comprises a central aperture having an inner wall.

12. The straw filler system of claim 11, wherein the inner wall comprises the plurality of internal openings aligned with the external openings on the periphery of the base.

13. The straw filler system of claim 11, wherein a concave floor and the inner wall define an inner cavity for receiving viscous material to be used to fill the plurality of straws.

14. The straw filler system of 6, wherein the concave floor comprises at least three openings for catching superfluous viscous material to recirculate.

* * * * *